US008164506B2

(12) United States Patent
Sim et al.

(10) Patent No.: US 8,164,506 B2
(45) **Date of Patent: *Apr. 24, 2012**

(54) ELECTROMAGNETIC ABSORBER USING RESISTIVE MATERIAL

(75) Inventors: Dong-Uk Sim, Daejeon (KR); Jong Hwa Kwon, Daejeon (KR); Sang Il Kwak, Daejeon (KR); Je Hoon Yun, Daejeon (KR); Chang-Joo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 64 days.

This patent is subject to a terminal disclaimer.

(21) Appl. No.: 12/540,058

(22) Filed: Aug. 12, 2009

(65) Prior Publication Data

US 2010/0156695 A1 Jun. 24, 2010

(30) Foreign Application Priority Data

Dec. 22, 2008 (KR) ..... 10-2008-0130776

(51) Int. Cl.
*H01Q 17/00* (2006.01)

(52) U.S. Cl. ..... 342/4; 342/1

(58) Field of Classification Search ..... 342/1–4
See application file for complete search history.

(56) References Cited

U.S. PATENT DOCUMENTS

| | | | | | |
|---|---|---|---|---|---|
| 2,875,435 | A | * | 2/1959 | McMillan | 342/1 |
| 4,012,738 | A | * | 3/1977 | Wright | 342/1 |
| 4,479,994 | A | * | 10/1984 | Berg | 428/195.1 |
| 4,972,191 | A | * | 11/1990 | Ishino et al. | 342/1 |
| 5,095,311 | A | * | 3/1992 | Sajiki et al. | 342/1 |
| 5,325,094 | A | * | 6/1994 | Broderick et al. | 342/1 |
| 5,510,792 | A | * | 4/1996 | Ono et al. | 342/4 |
| 5,576,710 | A | * | 11/1996 | Broderick et al. | 342/1 |
| 5,617,096 | A | * | 4/1997 | Takahashi | 342/4 |
| 5,808,350 | A | * | 9/1998 | Jack et al. | 257/440 |
| 6,225,939 | B1 | * | 5/2001 | Lind | 342/4 |
| 6,504,501 | B2 | * | 1/2003 | Tsuno et al. | 342/1 |
| 6,530,596 | B2 | * | 3/2003 | Sinnhuber | 280/731 |
| 6,538,596 | B1 | | 3/2003 | Gilbert | |
| 7,239,261 | B2 | * | 7/2007 | Fujieda et al. | 342/1 |

(Continued)

FOREIGN PATENT DOCUMENTS

| | | | | |
|---|---|---|---|---|
| JP | 2005-184012 | A | | 7/2005 |
| JP | 2006-073924 | A | | 3/2006 |
| JP | 2008034651 | A | * | 2/2008 |
| KR | 1020020063466 | A | | 8/2002 |
| KR | 1020070046936 | A | | 5/2007 |

(Continued)

OTHER PUBLICATIONS

Hang Wang; Wei Tang; Zhongxiang Shen; , "On the Design of Radar Absorbing Materials Using Left-Handed Transmission Line," Microwave Symposium, 2007. IEEE/MTT-S International. pp. 1475-1478, Jun. 3-8, 2007.*

(Continued)

*Primary Examiner* — Thomas Tarcza
*Assistant Examiner* — Matthew M Barker
(74) *Attorney, Agent, or Firm* — Ladas & Parry LLP

(57) ABSTRACT

An electromagnetic absorber using resistive material includes a ground plane of a conductive material; a dielectric layer formed on the ground plane; and a pattern layer in which specific unit cell patterns made of a resistive material are periodically arranged on the dielectric layer. The electromagnetic absorber is applied to an electronic toll collection system, a transportation device, a building structure, an electronic device and an anechoic chamber.

5 Claims, 13 Drawing Sheets

U.S. PATENT DOCUMENTS

| | | | | |
|---|---|---|---|---|
| 7,256,753 | B2 * | 8/2007 | Werner et al. | 343/909 |
| 7,495,181 | B2 * | 2/2009 | Matsushita et al. | 174/377 |
| 7,679,563 | B2 * | 3/2010 | Werner et al. | 343/700 MS |
| 7,804,439 | B2 * | 9/2010 | Yoshida et al. | 342/4 |
| 2001/0032701 | A1 * | 10/2001 | Kawanaka et al. | 156/276 |
| 2004/0263420 | A1 * | 12/2004 | Werner et al. | 343/909 |
| 2007/0222658 | A1 * | 9/2007 | Puscasu et al. | 342/1 |
| 2007/0247349 | A1 | 10/2007 | Masuda et al. | |
| 2008/0212304 | A1 * | 9/2008 | Masuda et al. | 361/818 |
| 2010/0090879 | A1 * | 4/2010 | Janis | 342/1 |
| 2010/0097048 | A1 * | 4/2010 | Werner et al. | 324/76.11 |

OTHER PUBLICATIONS

Q. Gao, et al; "Application of metamaterials to ultra-thin radar-absorbing material design", Electronics Letters, vol. 41, No. 17, Aug. 18, 2005.

D.J. Kern, et al; "A Genetic Algorithm Approach to the Design of Ultra-Thin Electromagnetic Bandgap Absorbers", Microwave and Optical Technology Letters, vol. 38, No. 1, Jul. 5, 2003.

* cited by examiner

ELECTROMAGNETIC ABSORBER USING RESISTIVE MATERIAL

CROSS-REFERENCE(S) TO RELATED APPLICATION(S)

The present invention claims priority of Korean Patent Application No. 10-2008-0130776, filed on Dec. 22, 2008, which is incorporated herein by reference.

FIELD OF THE INVENTION

The present invention relates to an electromagnetic absorber; and, more particularly, to an electromagnetic absorber which is capable of partially reflecting and transmitting electromagnetic waves in various applications.

BACKGROUND OF THE INVENTION

An electromagnetic bandgap (EBG) may be implemented by periodically arranging specifically designed unit cell patterns on a typical electric conductor at regular intervals. Since a tangential component of a magnetic field on the surface of the electromagnetic bandgap becomes zero, the electromagnetic bandgap has the characteristic of preventing current from flowing through the surface. Such an electromagnetic bandgap may be regarded as a magnetic conductor opposite to an electric conductor. The surface of the electromagnetic bandgap is a High-Impedance Surface (HIS) in configuration of a circuit. The frequency response characteristics of the electromagnetic bandgap may be checked through a reflection phase which refers to a difference between the phases of an incident wave on the surface of the electromagnetic bandgap and a reflected wave from the surface. The reflection phase of the electromagnetic bandgap becomes zero at a resonant frequency corresponding to a high impedance surface and varies in a range from −180° to 180° in a frequency band around the resonant frequency. When the structural parameters of the electromagnetic bandgap are adjusted, the reflection phase may vary.

In the structure of a typical electromagnetic bandgap, a dielectric layer and an array layer for unit cell patterns other than a metal conductive ground plane constitute the typical structure of a frequency selective surface (FSS). FSS is a surface formed by artificially and periodically arranging specific unit cell patterns so as to selectively transmit or reflect desired frequencies. Therefore, an electromagnetic bandgap not only completely blocks the progression of electromagnetic waves but also has the above-described unique physical characteristics, by virtue of providing a metal conductive ground plane for the characteristics of filtering of a specific frequency due to the FSS.

Conventional electromagnetic absorbers may be variously classified according to a type, material, absorption mechanism, etc. To date, most electromagnetic absorbers have been made of materials formed to have absorption characteristics. Since such an electromagnetic absorber is generally developed after much trial and error, it is disadvantageous in that the manufacturing process thereof is complicated and it is highly difficult to adjust an absorption frequency band and absorption characteristics. In contrast, a plate-type resonant absorber such as a $\lambda/4$ wave absorber or a Salisbury screen is composed of a resistive sheet, a dielectric spacer and a metal conductive ground plane. Therefore, such a plate-type resonant absorber is advantageous in that, since its construction is simplified, its manufacture can be facilitated and absorption performance can be easily adjusted, and in that, when the plate-type resonant absorber is constructed in multiple layers, multi-band absorption characteristics can be obtained. However, such a Salisbury screen is disadvantageous in that the thickness of the dielectric spacer from the metal conductive ground plane must be more than at least $\lambda/4$. In this case, when the above-described FSS is interposed between the dielectric spacer and the resistive sheet, the adjustment of thickness and absorption performance is possible thanks to the unique electromagnetic properties of the FSS. As a result, an electromagnetic absorber formed in this way has a structure formed by adding a resistive coating to the typical structure of the electromagnetic bandgap. Furthermore, when the unit cell patterns of the electromagnetic bandgap are designed and made of a resistive material on a metal conductor, such a resistive electromagnetic bandgap itself may function as a simpler electromagnetic absorber. Such an electromagnetic absorber may be applied to fields where existing electromagnetic absorbers have been applied in order to reduce the multiple reflection of electromagnetic waves, as a simpler structure that is easily manufactured and has low cost.

SUMMARY OF THE INVENTION

In view of the above, the present invention provides an electromagnetic absorber adopted to be used in various applications to partially reflect and transmit electromagnetic waves.

In accordance with an aspect of the present invention, there is provided an electromagnetic absorber, including:

a ground plane of a conductive material;

a dielectric layer formed on the ground plane; and a pattern layer in which specific unit cell patterns made of a resistive material are periodically arranged on the dielectric layer.

BRIEF DESCRIPTION OF THE DRAWINGS

The above features of the present invention will become apparent from the following description of embodiments given in conjunction with the accompanying drawings, in which.

DETAILED DESCRIPTION OF THE EMBODIMENTS

Hereinafter, exemplary embodiments of the present invention will be described in detail with reference to the accompanying drawings.

Figure 1A:
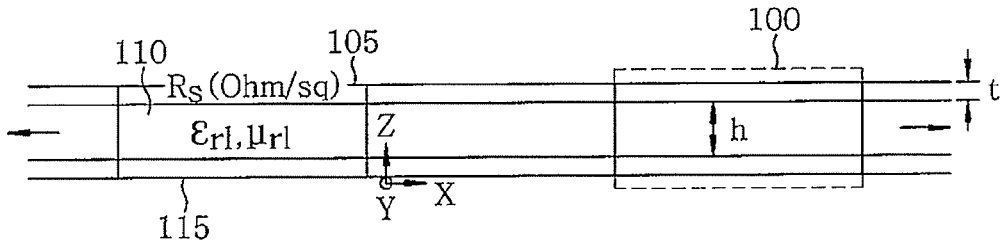
FIGS. 1A and 1B are front views of an electromagnetic absorber using a resistive material in accordance with an embodiment of the present invention.
Figure 1B:
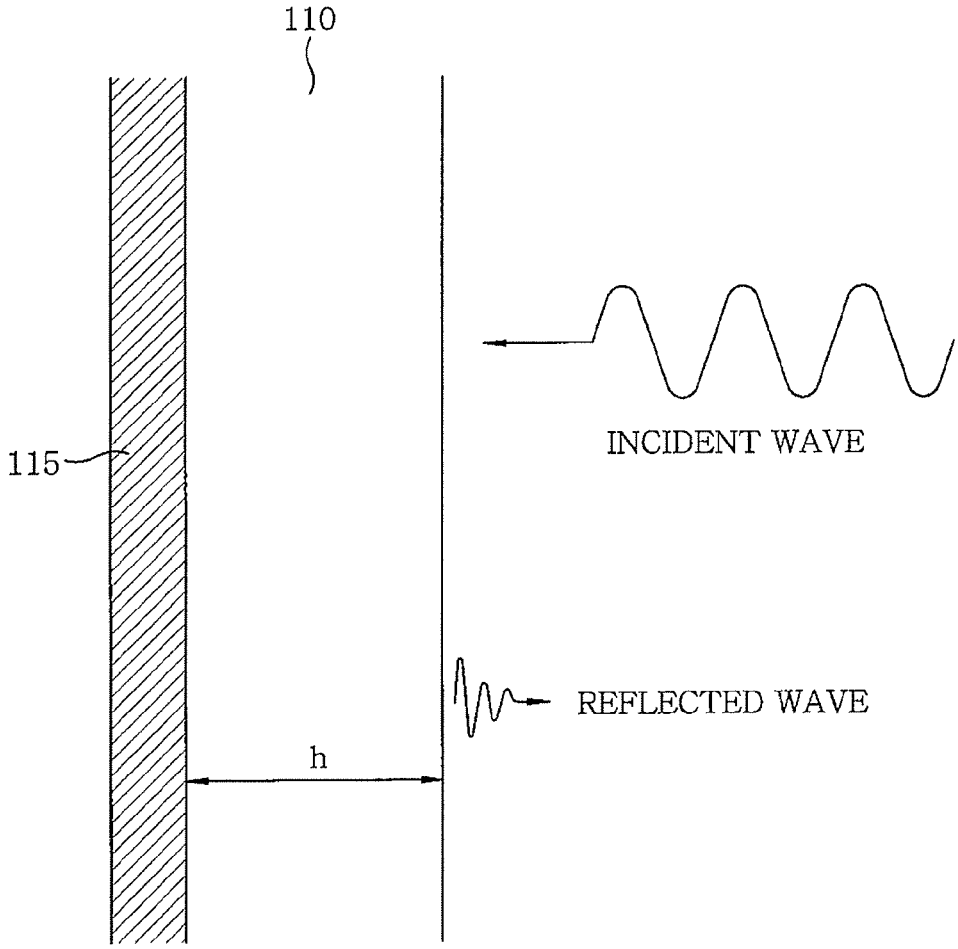

FIGS. 1A and 1B are front views of an electromagnetic absorber using a resistive material in accordance with an embodiment of the present invention. Referring to FIGS. 1A and 1B, the electromagnetic absorber is made by periodically arranging unit cells 100 for a resistive electromagnetic bandgap. Each of the unit cells 100 includes a metal conductive ground plane 115, a dielectric layer 110 formed on the metal conductive ground plane 115, and a unit cell pattern 105 made of a resistive material formed on the dielectric layer 110.

Both the dielectric layer 110 and the unit cell pattern 105 have a structure of incorporating loss into a frequency selective surface (FSS) typically composed of a dielectric material and a unit cell pattern made of a metal conductor. With such structure, the dielectric layer 110 and the unit cell pattern 105 made of a resistive material partially reflect and partially transmit incident waves at a desired frequency and adjust the phase in the dielectric layer 110. Here, the term 'resistive material' means a material allowing a metal conductor to have a loss. In this case, the intensities of electromagnetic waves that are partially reflected and partially transmitted are attenuated due to the resistive material. Further, the metal conductive ground plane 115 totally reflects the electromagnetic waves that have been partially transmitted through the unit cell pattern 105 made of the resistive material. Consequently, while partial transmission and partial reflection of the electromagnetic waves due to the unit cell pattern 105 made of the resistive material attenuately and consecutively occur in the dielectric layer, the intensities of the entire reflective waves are remarkably reduced, and thus the unit cell 100 functions as an electromagnetic absorber. FIG. 1B illustrates the mechanism of absorption of the present invention as described above.

Referring again to FIGS. 1A and 1B, The height 'h' from the metal conductive ground plane 115 to the unit cell pattern 105, dielectric characteristics '$\in_r$' and '$\mu_r$', the thickness 't' of the unit cell pattern 105 and the structural parameters of the unit cell pattern 105 act as important design parameters for absorption performance, and enable electromagnetic absorption bandwidth and performance to be adjusted.

Figure 2:
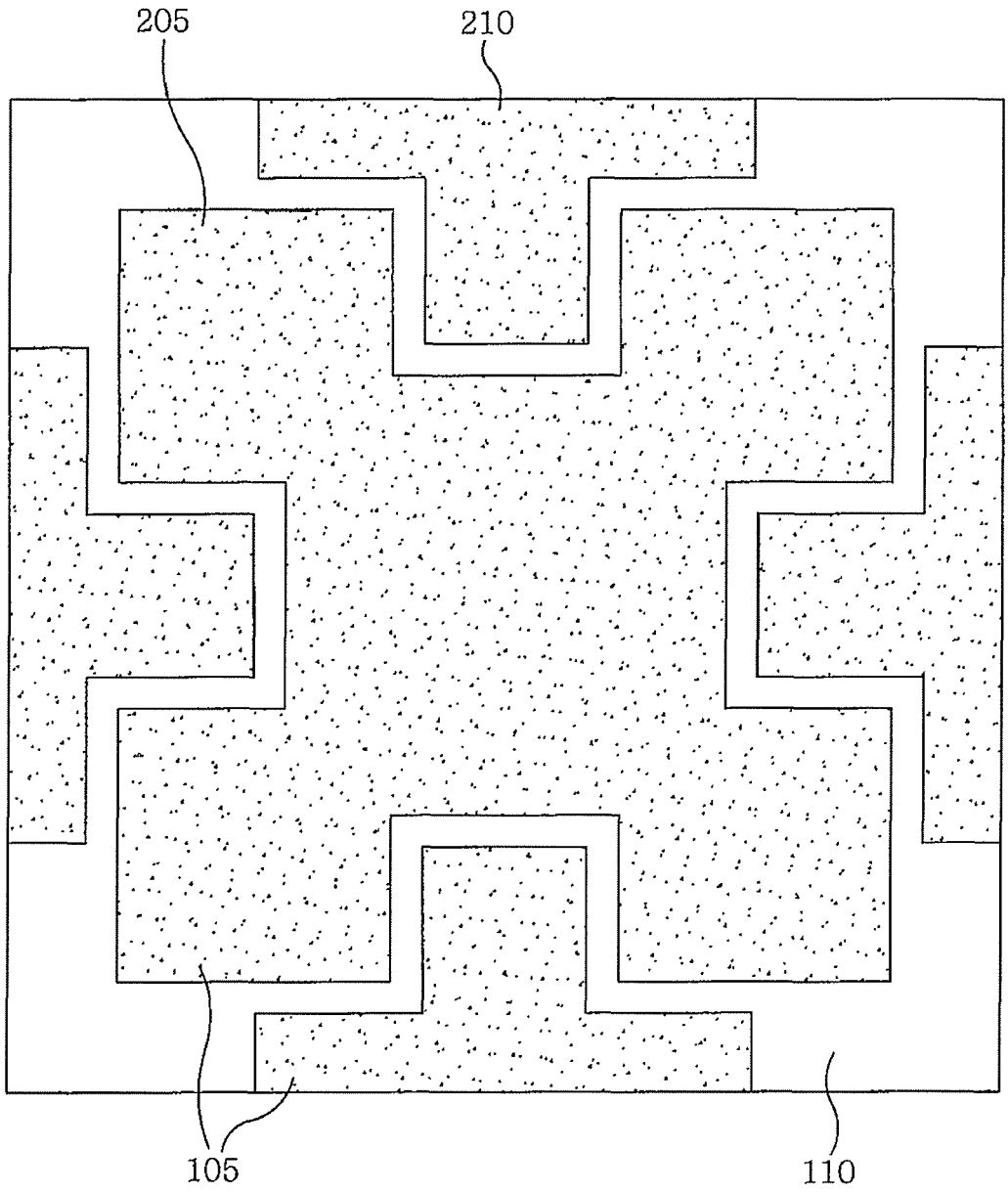
FIG. 2 is a plan view showing the structure of a unit cell pattern of an electromagnetic absorber in accordance with an embodiment of the present invention.

FIG. 2 is a plan view showing the structure of the unit cell pattern of an electromagnetic absorber in accordance with an embodiment of the present invention. Referring to FIG. 2, the unit cell pattern 105 of the electromagnetic absorber is formed on a dielectric layer 110 and includes a basic patch 205 and semi-orthogonal dipole patches 210. The basic patch 205, which is located at the center of the unit cell pattern 105, has a shape that center portions of respective sides of a regular square are cut out in a rectangular shape. The semi-orthogonal dipole patches 210 are arranged at the respective centers of the upper, lower, left and right sides of the basic patch 205 by a predetermined angle, which are interlocked with the basic patch 205 while being spaced apart from the basic patch 205 by a predetermined interval.

Figure 3:
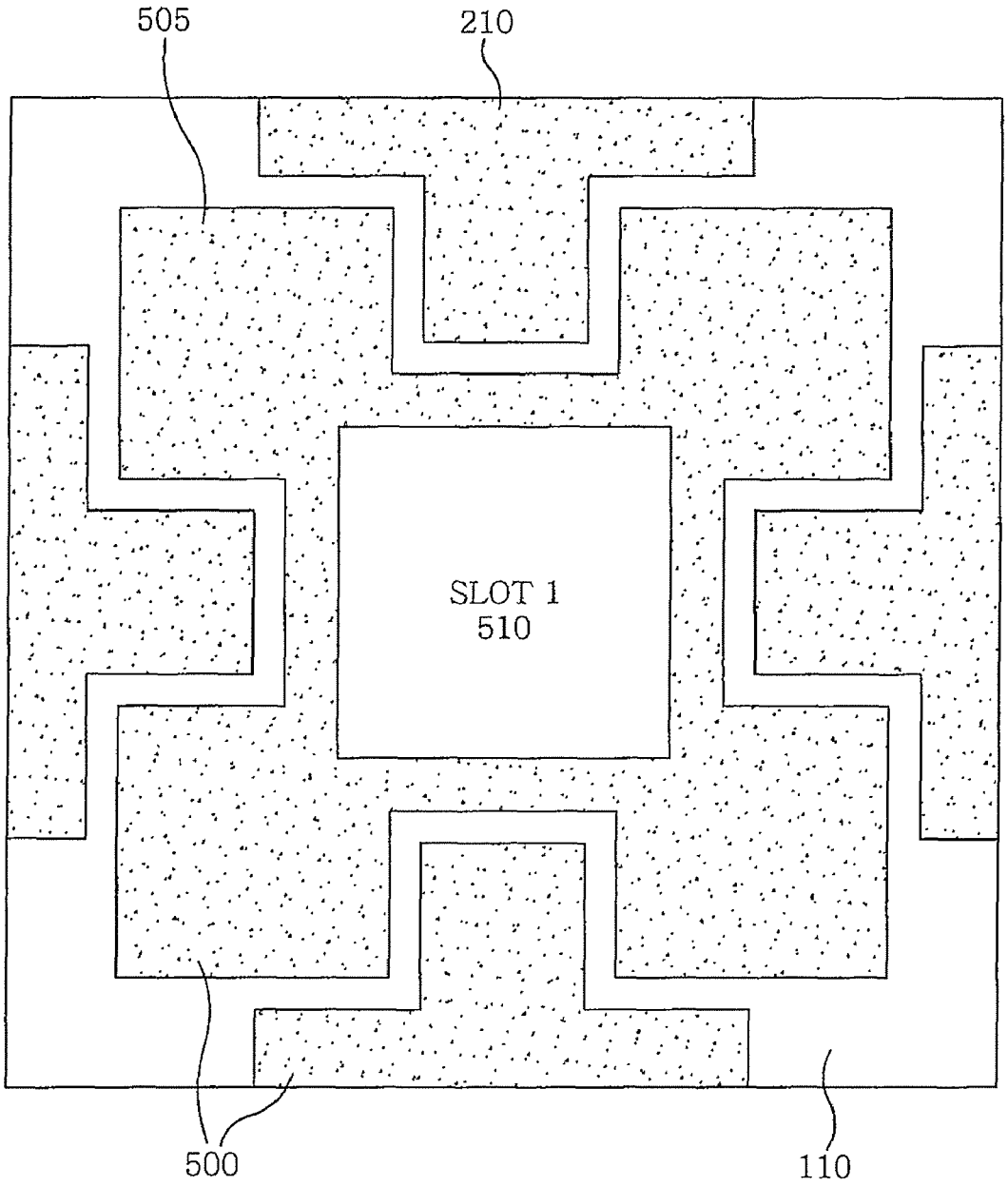
FIG. 3 is a plan view showing the structure of another unit cell pattern of an electromagnetic absorber in accordance with the embodiment of the present invention.

FIG. 3 is a plan view showing the structure of another unit cell pattern of an electromagnetic absorber in accordance with the present invention. Referring to FIG. 3, the unit cell pattern 500 of the electromagnetic absorber, which is formed on a dielectric layer 110, includes a basic patch 505, semi-orthogonal dipole patches 210 and a first slot 510. The basic patch 505, which is located at that center of the unit cell pattern 500, is configured such that center portions of respective sides of a regular square are cut out in a rectangular shape. The semi-orthogonal dipole patches 210 are arranged at the respective centers of the upper, lower, left and right sides of the basic patch 505 by a predetermined angle which are interlocked with the basic patch 505 while being spaced apart from the basic patch 505 by a predetermined interval. The first slot 510 is formed at the center of the basic patch 505. The first slot 510 functions as an element of controlling absorption bandwidth and absorption performance of the electromagnetic absorber as the size thereof is adjusted.

Figure 4:
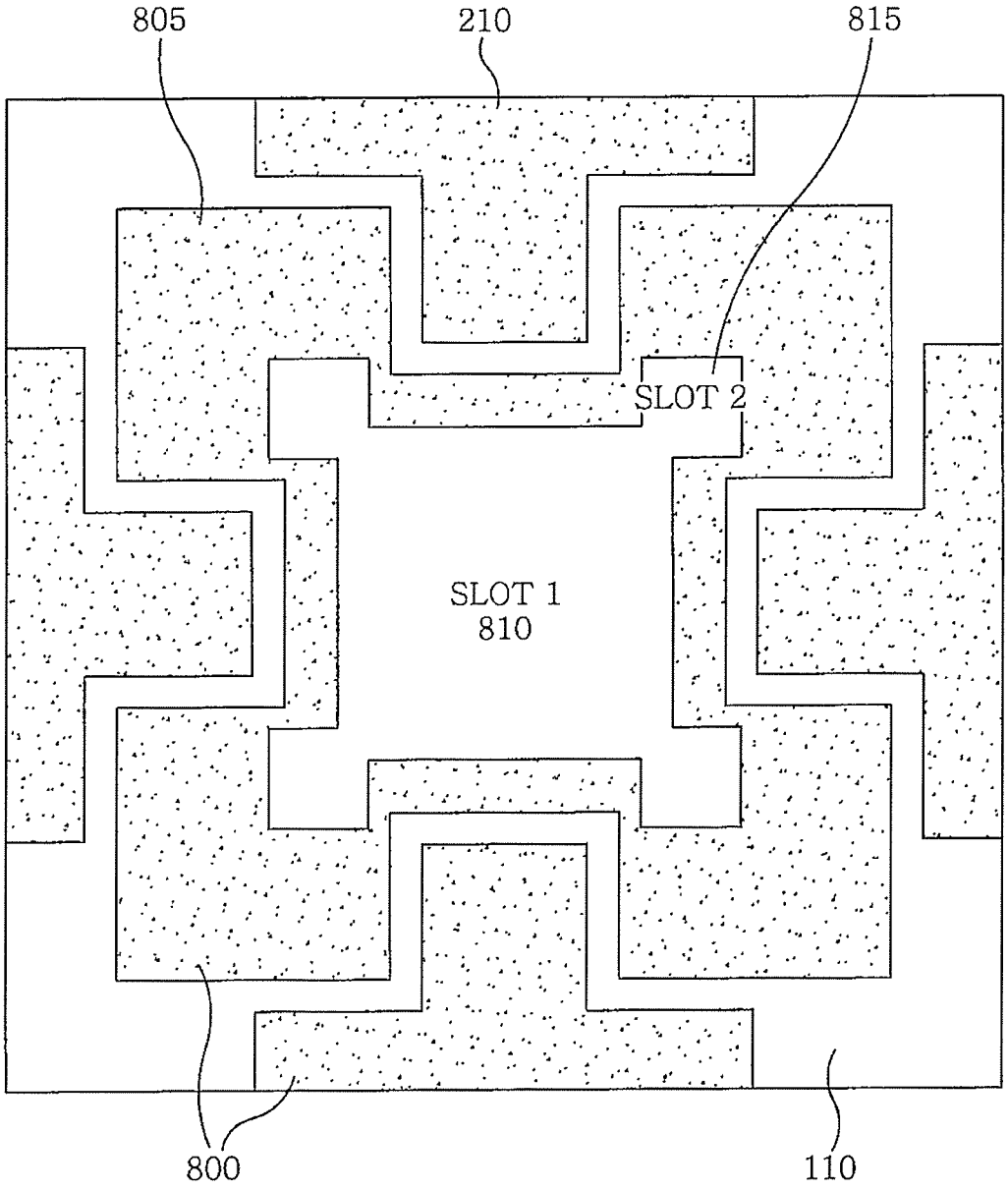
FIG. 4 is a plan view showing the structure of another unit cell pattern of an electromagnetic absorber in accordance with the embodiment of the present invention.

FIG. 4 is a plan view showing the structure of another unit cell pattern of an electromagnetic absorber in accordance with the present invention. Referring to FIG. 4, the unit cell pattern 800 of the electromagnetic absorber, which is formed on a dielectric layer 110, is composed of a basic patch 805, semi-orthogonal dipole patches 210, a first slot 810 and second slots 815. The basic patch 805, which is located at the center of the unit cell pattern 105, has a shape that center portions of respective sides of a regular square are cut out in a rectangular shape. The semi-orthogonal dipole patches 210 are arranged at the respective centers of the upper, lower, left and right sides of the basic patch 805 by a predetermined angle and are interlocked with the basic patch 805 while being spaced apart from the basic patch 205 by a predetermined interval. The first slot 810 is formed at the center of the basic patch. The second slots 815 are formed in the shape of the same regular square at the corners of the first slot 810, respectively.

The second slots 815 function as elements of controlling the absorption bandwidth and absorption performance of the electromagnetic absorber together with the first slot 810 as the size of the second slots 815 and the size of the first slot 810 are adjusted together.

Figure 5:
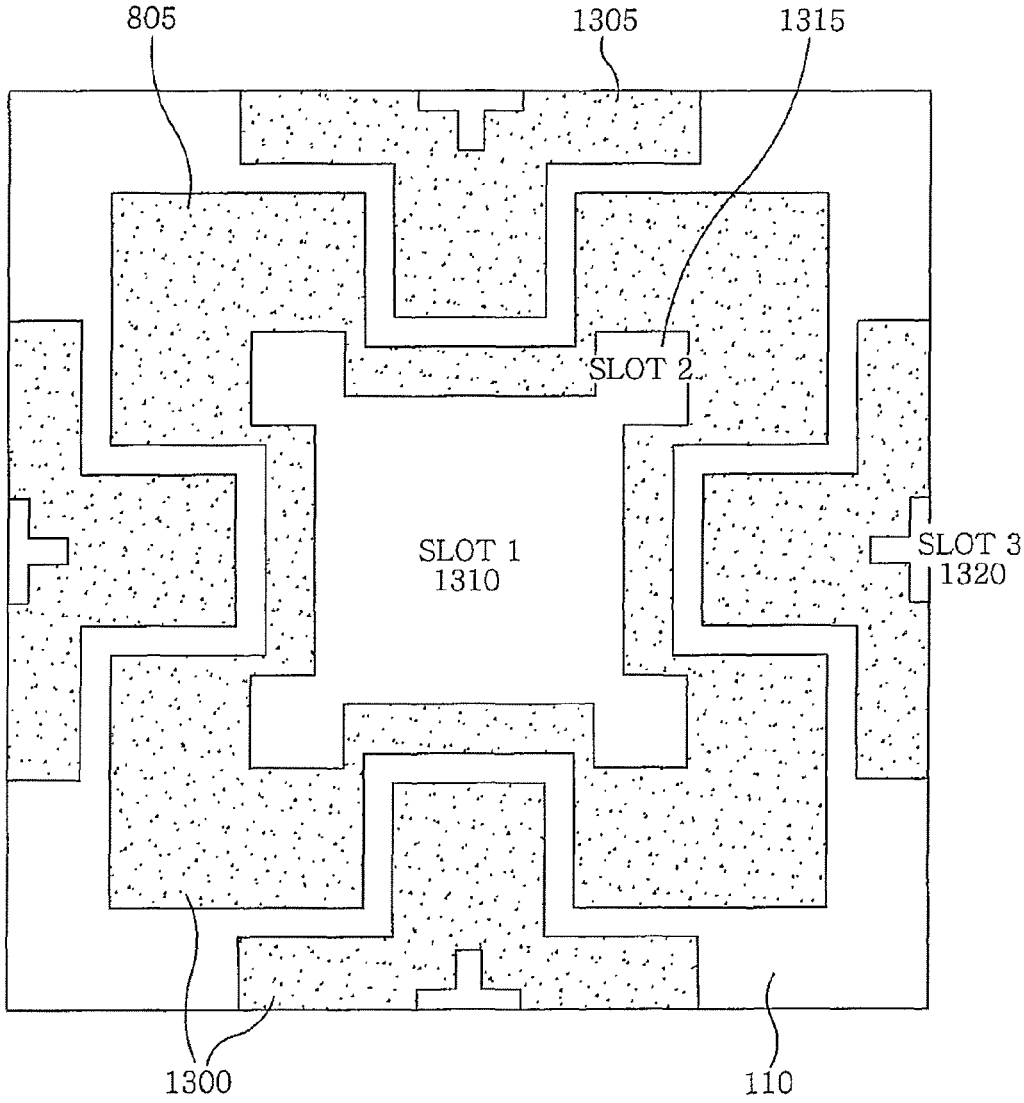
FIG. 5 is a plan view showing the structure of another unit cell pattern of an electromagnetic absorber in accordance with the embodiment of the present invention.

FIG. 5 is a plan view showing the structure of another unit cell pattern of an electromagnetic absorber in accordance with the present invention. Referring to FIG. 5, the unit cell pattern 1300 of the electromagnetic absorber is formed on a dielectric layer 110 and includes a basic patch 805, semi-orthogonal dipole patches 1305, a first slot 1310, second slots 1315 and third slots 1320. The basic patch 805 is configured such that center portions of respective sides of a regular square are cut out in a rectangular shape, and is located at that center of the unit cell pattern 1300 as in FIG. 4. The semi-orthogonal dipole patches 1305 are arranged at the respective centers of the upper, lower, left and right sides of the basic patch 805 by a predetermined angle and are interlocked with the basic patch while being spaced apart from the basic patch 805 by a predetermined interval. The first slot 1310 is formed at the center of the basic patch. The second slots 1315 are formed respectively in the shape of the same regular square at the respective corners of the first slot 1310. The third slots 1320 are formed in the semi-orthogonal dipole patches 1305 in any shape.

The third slots 1320 function as elements of controlling the absorption bandwidth and absorption performance of the electromagnetic absorber together with the first and second slots, 1310 and 1315, as the size of the third slots 1320 and the sizes of the first and second slots 1310 and 1315 are adjusted together.

As shown in the embodiment of FIGS. 2 to 5, it is apparent to those skilled in the art that the structure of the unit cell patterns of the electromagnetic absorber may be modified depending on design choices.

Figure 6:
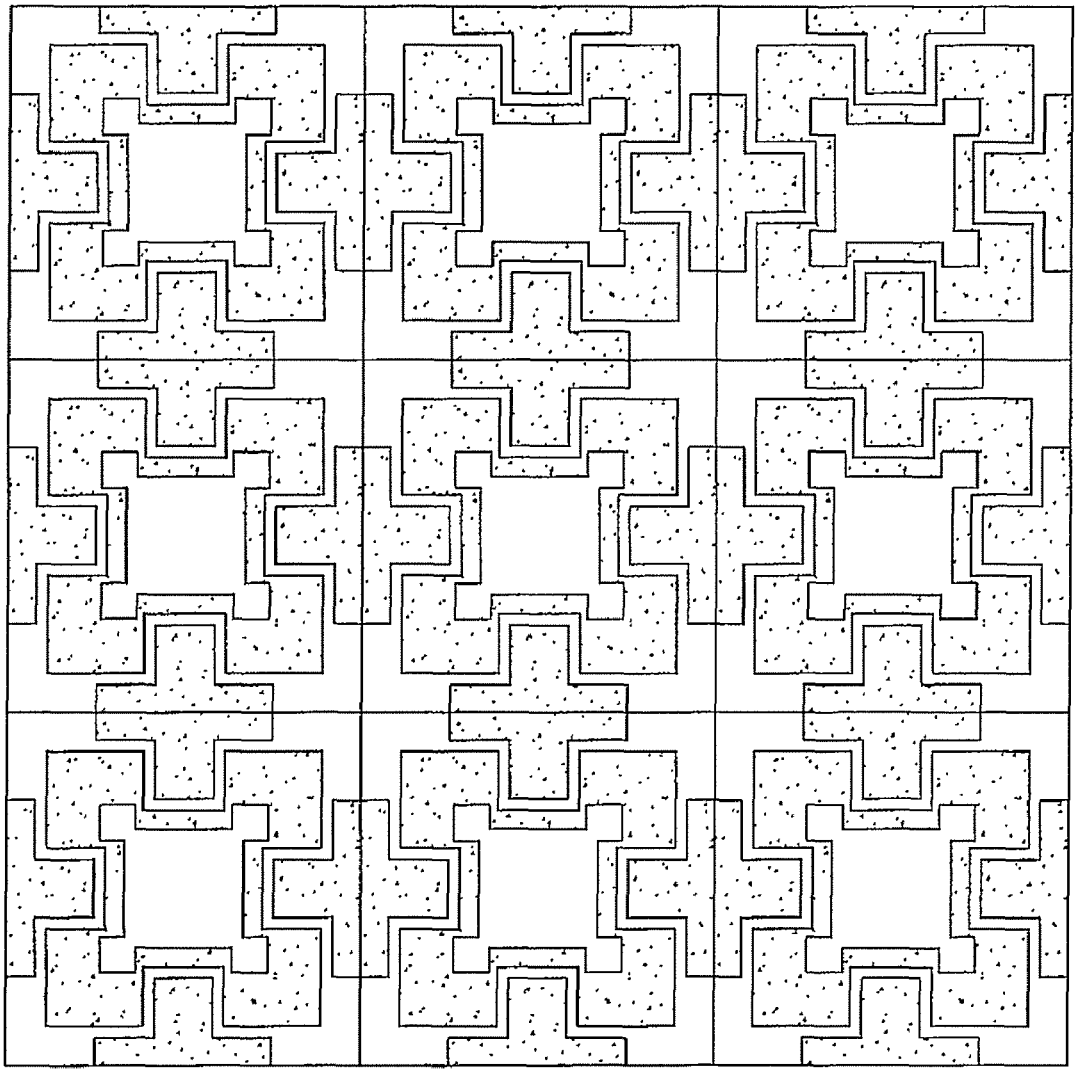
FIG. 6 is a diagram showing an example of the entire pattern when the unit cell pattern of the electromagnetic absorber of FIG. 4 is periodically arranged.

FIG. 6 is a diagram showing an example of the entire pattern of an electromagnetic absorber in which the unit cell patterns of FIG. 4 are periodically arranged. The number of unit cells arranged in the present electromagnetic absorber may be variously set depending on an application target.

Figure 7:
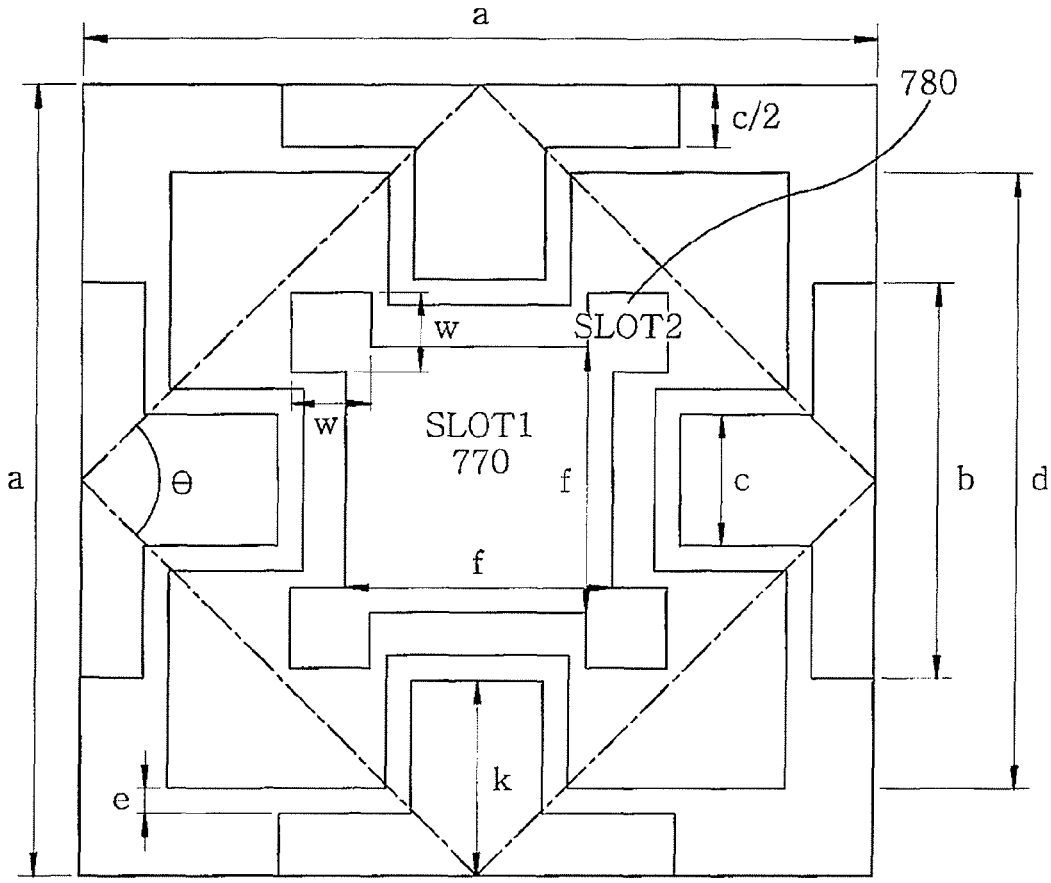
FIG. 7 is a diagram showing design parameters for the unit cell pattern of the electromagnetic absorber of FIG. 4 in accordance with the present invention.

FIG. 7 is a diagram showing design parameters for the unit cell pattern of the electromagnetic absorber of FIG. 4 in accordance with the present invention. Each of parameters shown in FIG. 7 controls absorption bandwidth and absorption performance as a parameter for the electromagnetic absorber, where 'a' stands for a length of one side of the unit cell pattern, 'b' for a length of the side of each semi-orthogonal dipole patch in contact with the side of the unit cell pattern, 'c' for a length of the inner side among the sides of the semi-orthogonal dipole patch interlocked with the basic patch, 'd' for a length of one side of the basic patch, 'e' for an interval between the basic patch and the semi-orthogonal dipole patch, 'k' for a vertical height of the semi-orthogonal dipole patch from one side of the unit cell pattern, 'θ' for an internal angle between a line connecting a center point of one side of the unit cell pattern to another center point of its adjacent side and a line connecting the center point of one side of the unit cell pattern to another center point of its opposite side, 'f' for a length of one side of a first slot 770, and 'w' for a length of one side of a second slot 780.

Figure 8:
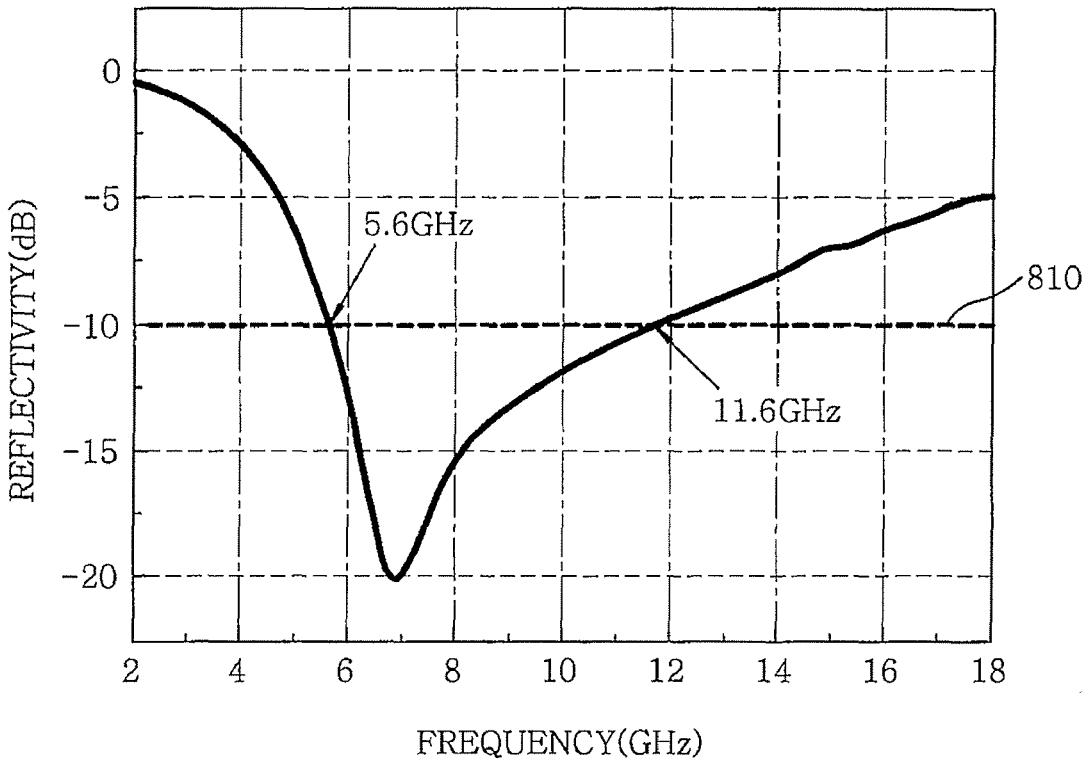
FIG. 8 is a diagram showing the electromagnetic absorption bandwidth and absorption performance of the electromagnetic absorber of FIG. 7 depending on the parameter values of FIG. 7.

FIG. 8 is a diagram showing the electromagnetic absorption bandwidth and absorption performance of the electromagnetic absorber with the structure of FIG. 7 depending on the parameter values of FIG. 7, where the parameter values are given by $R_s$=40 Ohm/sq, a=30 mm, b=15 mm, c=5 mm, d=23 mm, e=1 mm, h=5 mm, k=7.5 mm, t=0.001 mm, θ=45°, $\in_r$=1, $\mu_r$=1, f=10 mm, and w=2.5 mm. In this case, reflectivity indicating absorption performance is defined as follows, $$R\ (\mathrm{dB})=20\times\log(r_{DUT}/r_G),$$

where R is reflectivity, $r_{DUT}$ is the reflection coefficient of the electromagnetic absorber, and $r_G$ is the reflection coefficient of a metal conductive surface. In the present invention, a reference of absorption bandwidth is determined as −10 dB. Since a frequency band having a reflectivity equal to or less than a reference line 810, i.e. −10 dB, ranges from 5.6 GHz to 11.6 GHz, the frequency band in the present embodiment ranges from 5.6 GHz to 11.6 GHz. In this way, as seen in FIGS. 7 and 8, by adjusting the structural parameters of the resistive electromagnetic bandgap, the absorption performance (maximum absorption frequency and absorption bandwidth) of the electromagnetic absorber can be easily controlled.

Figure 9:
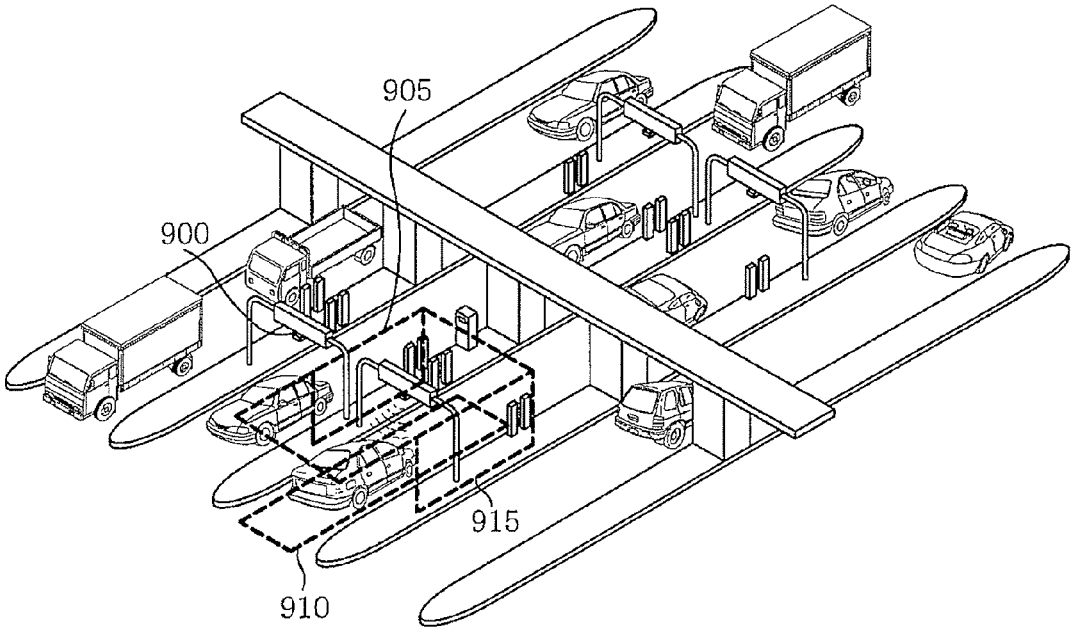
FIG. 9 is an exemplary application of the electromagnetic absorber to an electronic toll collection system, Hi-Pass, currently being utilized in Korea.

FIG. 9 is an exemplary application of the electromagnetic absorber to an electronic toll collection system, Hi-Pass, currently being utilized in Korea. Vehicles equipped with a Hi-Pass terminal may pass through a toll gate without stopping to pay a toll, thanks to radio communication with a Hi-Pass detector installed at the tollgate. However, since this electronic toll collection system uses traffic lanes of the existing toll gate without changing them, radio waves may be multiply reflected by a road surface 910, a ceiling 905 and a pole 900 of the tollgate, and other surrounding objects. As a result, malfunction may occur on related equipments, and electromagnetic interference may be caused between adjacent Hi-Pass detectors. Therefore, in order to prevent this phenomenon, there is a need to suppress the multiple reflections by installing the electromagnetic absorber between surrounding objects and each of the Hi-Pass detectors. As shown in FIG. 9, when the electromagnetic absorber of the present invention is installed on the road surface 910 and the ceiling 905 of the toll gate, the pole 900 between Hi-Pass detectors, and on other surrounding objects that may cause the multiple reflection, the malfunction of the electronic toll collection system may be reduced.

The electromagnetic absorber may be applied to airplanes, ships and vehicles so as to implement a stealth function. The stealth function is required to prevent the airplanes, ships or vehicles from being detected by radar, on a military purpose. Up to date, various technologies for realizing stealth performance have been used. These technologies, when electromagnetic waves radiated from a directional antenna of an enemy are reflected from a device of being detected, allow the device to have the stealth function by controlling in various forms the reflected waves. In particular, the device with the stealth function may avoid the radar of the opposite party by inducing diffused reflection of electromagnetic waves at the reflection stage. For this function, most military equipments are aimed at being in polyhedral form and being applied with an electromagnetic absorber made of ferrite material to absorb electromagnetic waves from the radar of the opposite party. For the above purpose, the electromagnetic absorber of the present invention may be applied to airplanes, ships and vehicles. When the electromagnetic bandgap of the present invention is installed, the stealth function may be realized by absorbing 90% or more of incident radar waves on surface of the device which the electromagnetic bandgap is installed on to reduce its reflection to the limit, as shown in FIG. 8. Since the electromagnetic absorber can be installed on a plane or a curved plane as a form of a thin sheet and may selectively absorb frequencies, it is advantageous in that it may be designed to have a stealth function, easily manufactured and installed, and may have low cost.

Figure 10A:
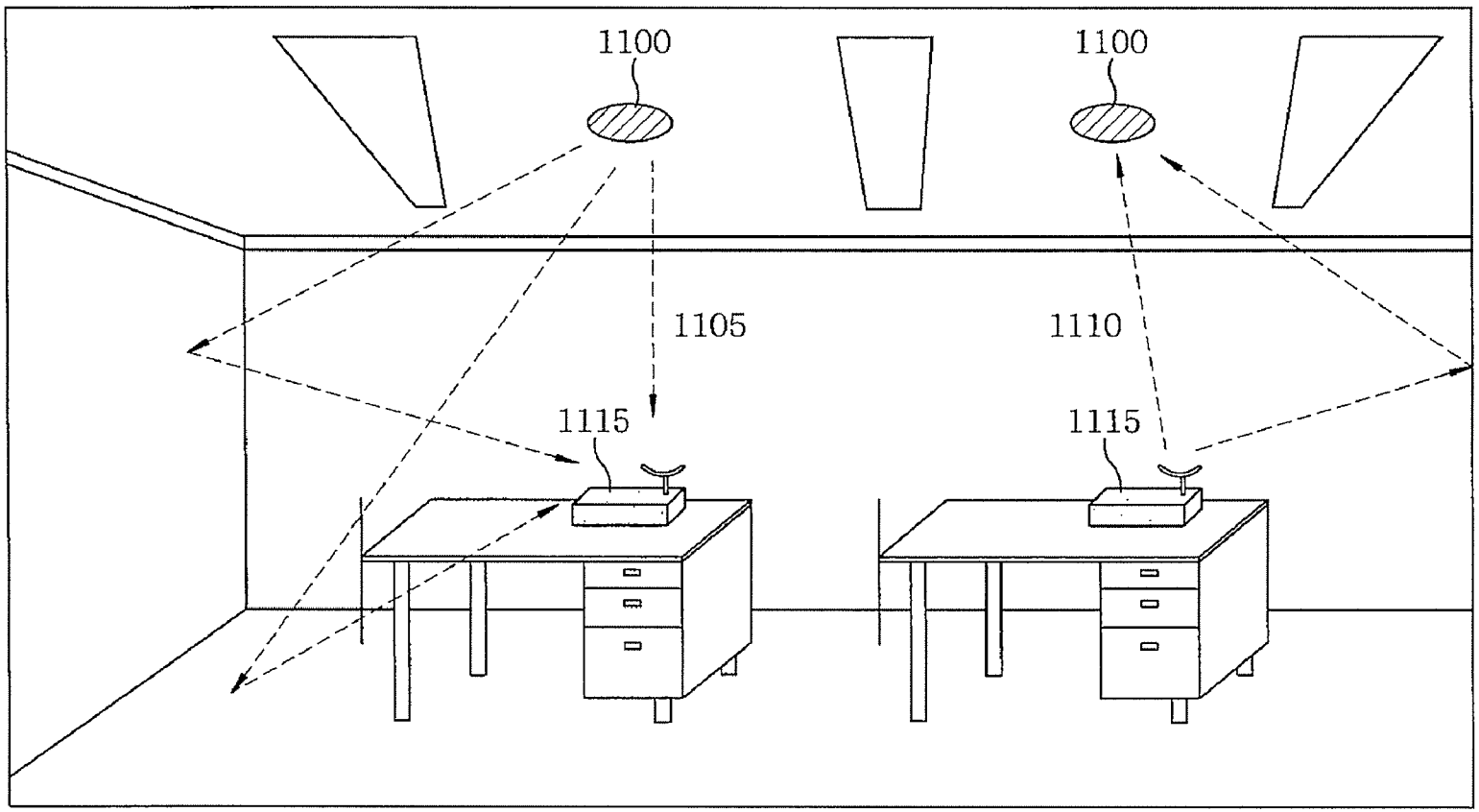
FIGS. 10A and 10B are diagrams for explaining the effects of the electromagnetic absorber of the present invention installed in buildings such as a library, an office, a house and a medical facility.
Figure 10B:
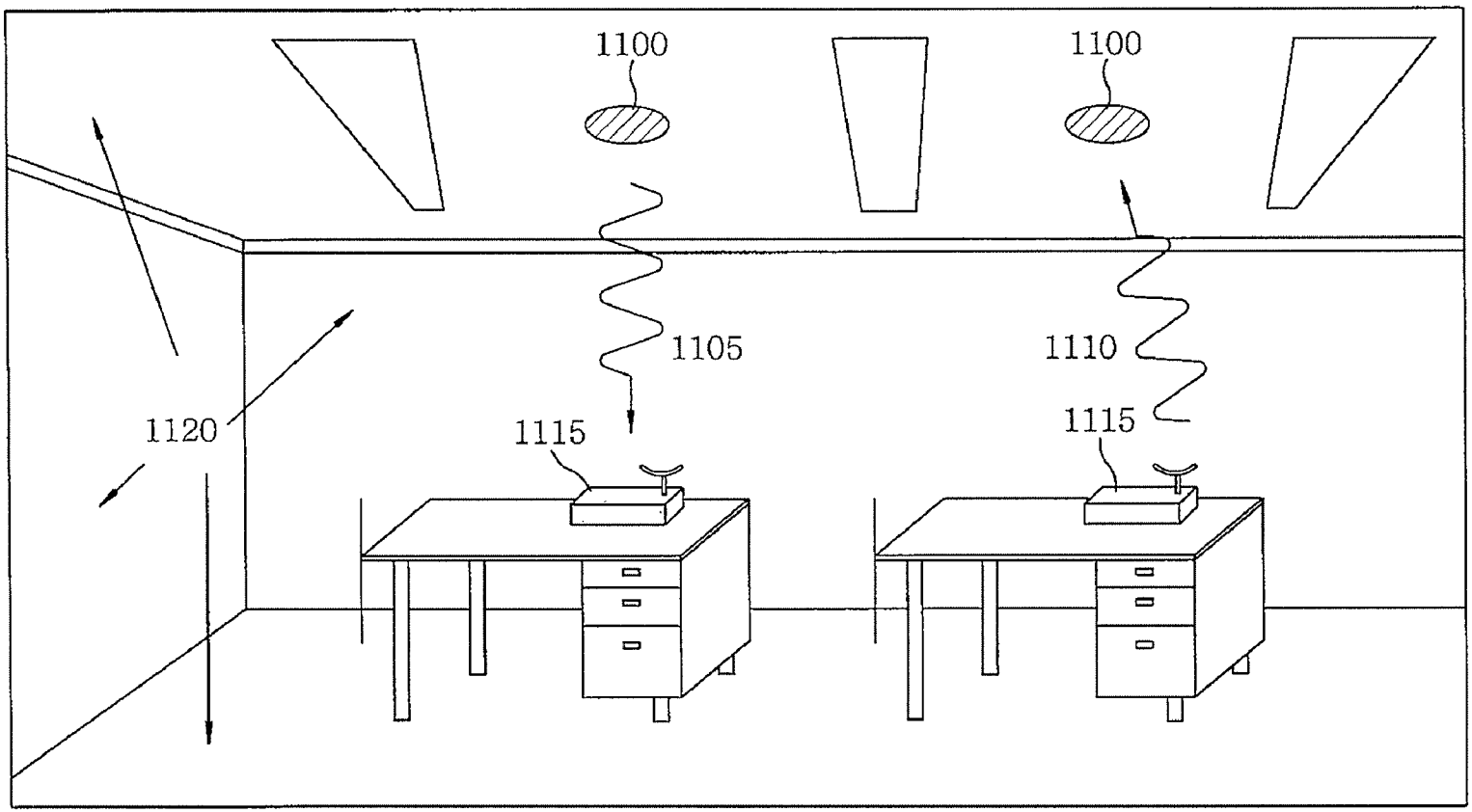

FIGS. 10A and 10B are diagrams for explaining the effects of an electromagnetic absorber installed in buildings providing a wireless communication environment such as a library, an office, a house, or a medical facility, in accordance with the present invention. Due to the multiple reflection of electromagnetic waves from walls or surrounding objects in such a building, the malfunction of information devices being attributable to electromagnetic interference between wireless systems, communication errors in a Wireless Local Area Network (WLAN) environment, or electromagnetic interference between various medical instruments such as monitors, artificial respirators and magnetic resonance imaging (MRI) devices provided in medical facilities may occur. Referring to FIGS. 10A and 10B, electromagnetic waves from various paths being attributable to indoor multiple reflection are present between WLAN access points (APs) 1100 and PCs 1115, and thus the probability of causing communication errors is increased. In this case, if the electromagnetic absorber is installed on a wall 1120, the multiple reflection of electromagnetic waves from the wall surface is suppressed, creating a safe wireless communication environment. In the same way, the problem of electromagnetic interference caused by the multiple reflection of electromagnetic waves between wireless communication devices in a building can be solved.

The electromagnetic absorber may also be applied to a Personal Computer (PC) in accordance with the present invention. Referring to the PC generally being used, since electronic parts, such as a power supply, a Central Processing Unit (CPU), a mother board, a hard disk, and Random Access Memory (RAM), are installed close to each other in the PC, tiny electromagnetic waves generated by the electronic parts are multiply reflected from the wall of the PC made of a metal conductor. As a result, a resonance phenomenon, which is, a phenomenon that energy is concentrated in a specific frequency band occurs, causing the problems of electromagnetic interference such as damage of the electronic parts and high frequency oscillation. Consequently, as a method for solving these problems of electromagnetic interference, electromagnetic absorbers may be applied to the PC.

Figure 11:
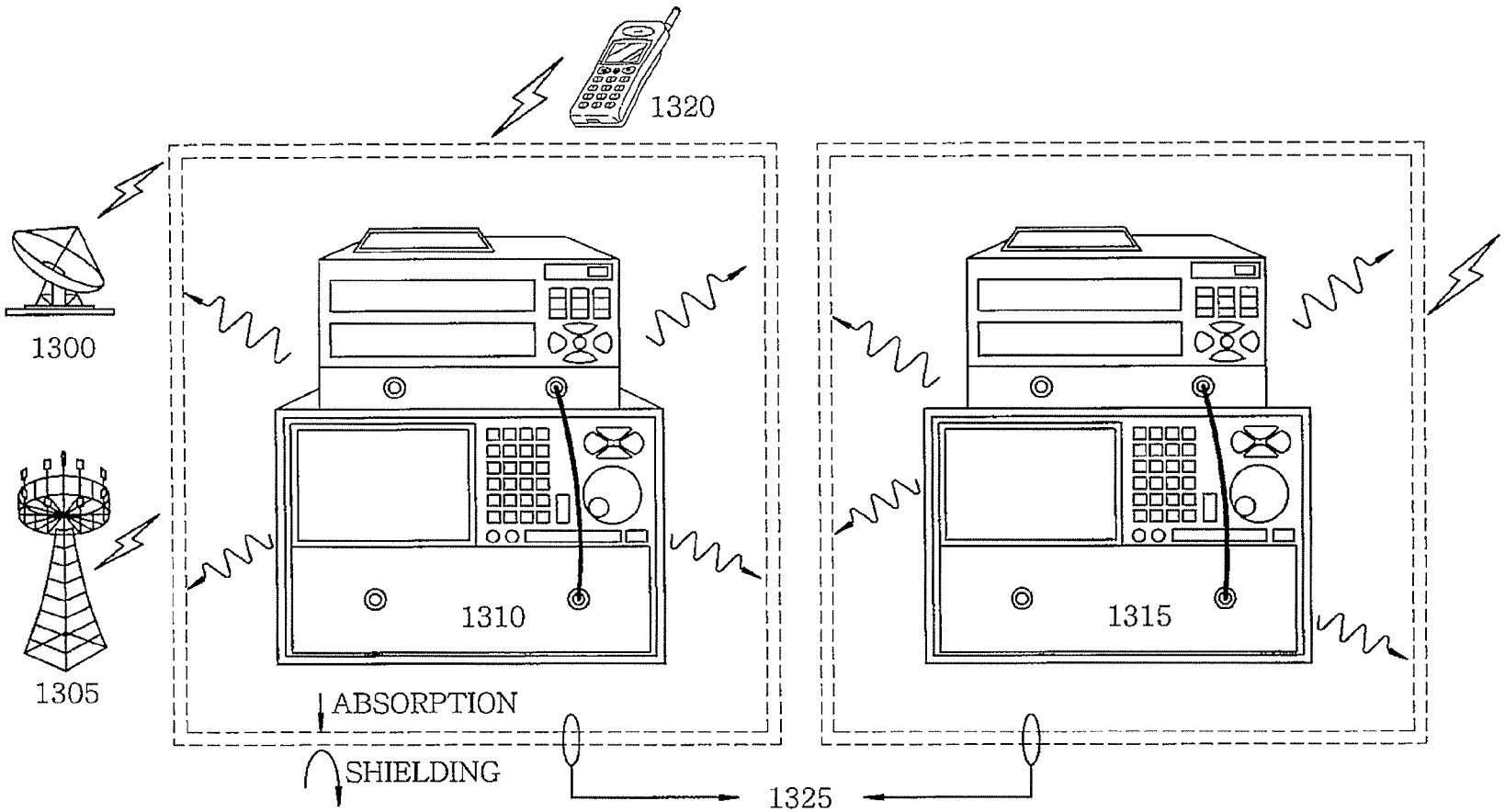
FIG. 11 is a diagram showing adjacent medical instruments operating in ISM (Industrial, Scientific and Medical) band in a medical facility.

FIG. 11 is a diagram showing adjacent medical instruments operating in an Industrial, Scientific and Medical (ISM) band in a medical facility. These medical instruments are vulnerable to an influence of external electromagnetic waves. Accordingly, referring to FIG. 11, when electromagnetic absorbers 1325 of the present invention are installed, the medical instruments may be shielded from electromagnetic waves generated by a broadcast transmitting station 1300, a satellite base station 1305, and a mobile communication terminal 1320. Furthermore, if electromagnetic waves generated by a specific medical instrument 1310 or 1315 affect another adjacent medical instrument 1310 or 1315, the electromagnetic absorbers 1325 may suppress the influence of the electromagnetic interference by absorbing the electromagnetic waves.

Figure 12:
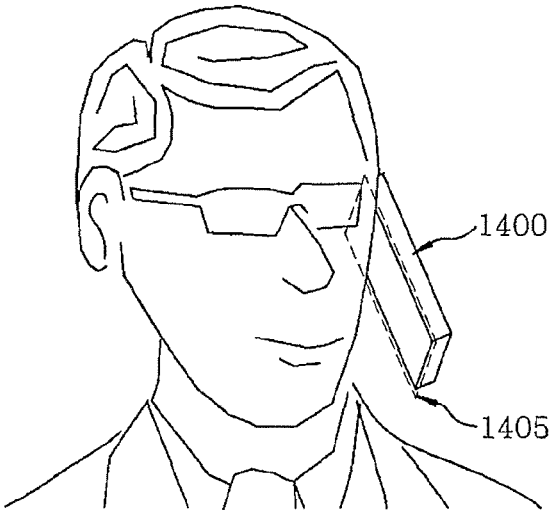
FIG. 12 is a diagram showing a mobile communication terminal and the cephalic model of a human body.

FIG. 12 is a diagram showing a mobile communication terminal and the cephalic model of a human body. With the increase in the use of mobile communication terminals, i.e. portable devices, an influence of electromagnetic waves generated by the terminals on a human body has also become an important issue. Further, although relations between electromagnetic waves and a human body influenced thereby are not clearly disclosed, it has been reported that various kinds of diseases may be caused such as leucosis, brain tumor, headache and amblyopia, and when electromagnetic waves are accumulated in the human body, confusion of brain waves and destruction of males of the generative function may be caused. Accordingly, many researches into the prevention of the negative influence of electromagnetic waves on a human body by blocking electromagnetic waves have been conducted. Referring to FIG. 12, when an electromagnetic absorber 1405 of the present invention is installed on a mobile communication terminal 1400, there is an advantage of efficiently absorbing electromagnetic waves emitted from the terminal 1400 into the direction of the human head to greatly reduce the rate of the human head absorbing the electromagnetic waves. Further, such an electromagnetic reduction method of protecting the human body from the electromagnetic waves may be very effectively utilized for wearable devices in future.

Figure 13:
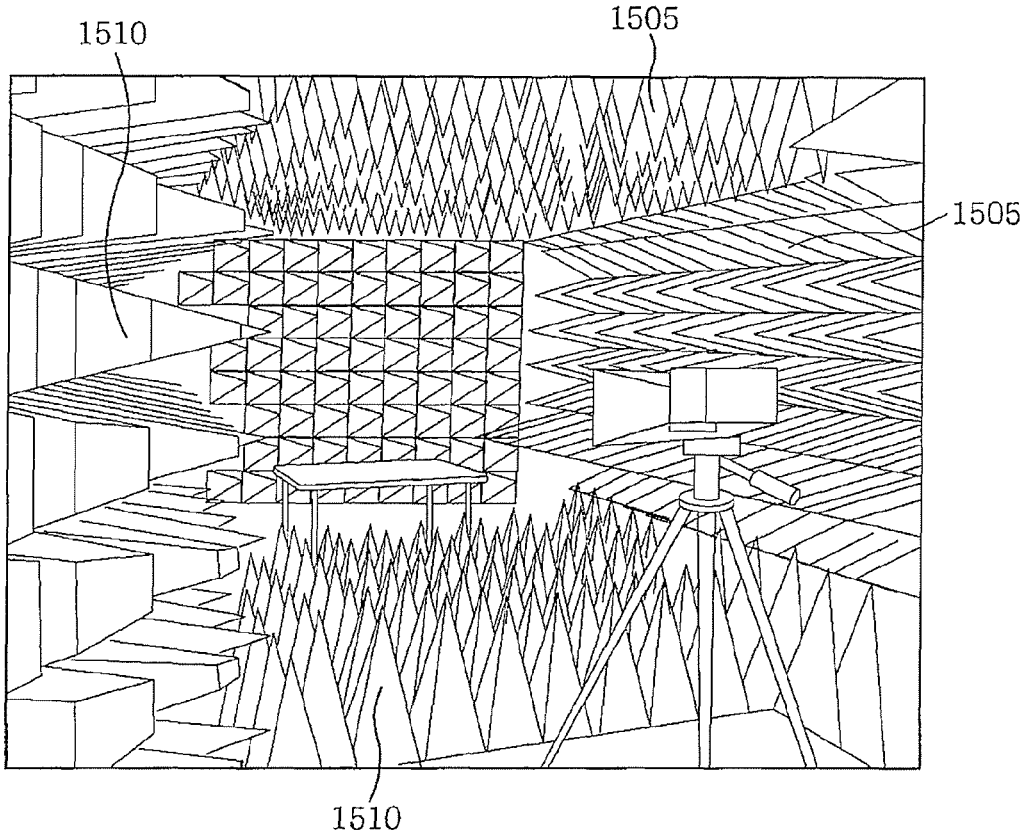
FIG. 13 is a diagram showing an anechoic chamber.

FIG. 13 is a diagram showing an anechoic chamber. A conventional anechoic chamber generally uses a pyramid-shaped electromagnetic absorber made of ferrite or the like, which is, however, profitable only when a very wide frequency band and a large space are given. Therefore, there is a disadvantage in that installation cost increases, and maintenance, for example, keeping constant temperature and constant humidity, for preserving the absorption performance of the material such as ferrite is quite difficult. Referring to FIG. 13, when electromagnetic absorbers 1505 and 1510 of the present invention are applied to the anechoic chamber, the anechoic chamber which has low installation costs, convenient maintenance performance and a small size while using a wide frequency band, may be installed. Further, when the electromagnetic absorbers 1505 and 1510 of the present invention are additionally applied to an existing electromagnetic absorber made of a material such as ferrite, existing absorption performance can be further improved.

As described above, the present invention may reduce the occurrence of malfunction by improving a wireless communication environment between an electronic toll collection base station and a vehicle terminal. When the present invention is applied to airplanes, ships and vehicles, it may allow them to have stealth performance. Further, when the present invention is applied to libraries, offices, houses, and medical facilities, a safer wireless communication environment and a more stable medical environment can be created. In addition, when the present invention is applied to electronic devices such as PCs, or medical instruments, the devices can be protected from the problem of electromagnetic interference due to unnecessary electromagnetic waves. When the present invention is applied to mobile communication terminals, the rate of human body absorbing electromagnetic waves may be reduced. Moreover, when the present invention is applied to an anechoic chamber, an advantage of the reduction in space and costs may be obtained.

While the invention has been shown and described with respect to the embodiments, it will be understood by those skilled in the art that various changes and modifications may be made without departing from the scope of the invention as defined in the following claims.

What is claimed is:

1. An electromagnetic absorber, comprising:

a plurality of unit cells periodically arranged to form a resistive electromagnetic bandgap, wherein each of the unit cells includes:

a ground plane of a conductive material;

a dielectric layer formed on the ground plane; and a pattern layer made of a resistive material and formed on the dielectric layer, wherein a unit cell pattern is formed within the pattern layer by arranging polygonal patches, wherein the unit cell pattern includes:

a basic patch; and a plurality of semi-orthogonal dipole patches interlocked with the basic patch while being spaced apart from the basic patch.

2. The electromagnetic absorber of claim 1, wherein the basic patch is located at the center of the unit cell pattern and has a shape in which center portions of upper, lower, left and right sides of a regular square are cut out in a rectangular shape, and the semi-orthogonal dipole patches are arranged at the respective centers of the upper, lower, left and right sides of the basic patch.

3. The electromagnetic absorber of claim 1, wherein:

the basic patch is located at the center of the unit cell pattern and has a shape in which center portions of upper, lower, left and right sides of a regular square are cut out in a rectangular shape, the semi-orthogonal dipole patches are arranged at the respective centers of the upper, lower, left and right sides of the basic patch, and the basic patch includes a slot formed at the center of the basic patch for controlling absorption bandwidth and absorption performance.

4. The electromagnetic absorber of claim 1, wherein the basic patch includes slots formed in the shapes of squares at corners of the first slot for controlling absorption bandwidth and absorption performance.

5. The electromagnetic absorber of claim 1, wherein semi-orthogonal dipole patches include slots formed in the semi-orthogonal dipole patches for controlling absorption bandwidth and absorption performance.

* * * * *